US005474473A

United States Patent [19]

Perretta et al.

[11] Patent Number: 5,474,473

[45] Date of Patent: Dec. 12, 1995

[54] WIRING INTEGRATION/BACKSHELL INTERFACE CONNECTOR ASSEMBLY

[75] Inventors: Frederick A. Perretta; Joseph S. Yednasty, both of Huntington, Conn.

[73] Assignee: United Technologies Corporation, Hartford, Conn.

[21] Appl. No.: 354,980

[22] Filed: Dec. 13, 1994

[51] Int. Cl.[6] ..... H01R 9/03

[52] U.S. Cl. ..... 439/610; 439/76.1; 439/608; 439/620

[58] Field of Search ..... 439/55, 67, 76.1, 439/77, 78, 81, 82, 95, 130, 607, 608, 610, 620; 361/736, 748, 749

[56] References Cited

U.S. PATENT DOCUMENTS 5,244,417 9/1993 Perretta et al. ..... 439/610

5,246,376 9/1993 Schuhl et al. ..... 439/610 X 5,308,264 5/1994 Perretta et al. ..... 439/607 X 5,342,203 8/1994 Perretta et al. ..... 439/607 X

*Primary Examiner*—Khiem Nguyen

*Attorney, Agent, or Firm*—William W. Jones

[57] ABSTRACT

A shielded connector assembly for interconnecting individual conductors in an electrical wire harness is provided with a ground ring which eliminates unshielded conductor wire segments after the individual conductor shielding has been stripped. A filter ring assembly is included in the connector assembly for filtering high frequency signals to eliminate cross talk between high and low frequency signal conductors in the same wire harness. Transmission leakage is also eliminated at the juncture between the individual conductors and a circuit board included in the assembly.

12 Claims, 2 Drawing Sheets

WIRING INTEGRATION/BACKSHELL INTERFACE CONNECTOR ASSEMBLY

TECHNICAL FIELD

This invention relates to an electrical connector assembly for interconnecting wire harnesses to each other or to electrical instruments. More particularly, this invention relates to a connector assembly which eliminates signal leakage and inter-conductor interference between high frequency and low frequency signal conductors in the wire harness.

BACKGROUND ART

The utility of compact backshell/wiring integration and interface systems to replace bulky wiring harness connectors for interconnecting individual conductor wires in the wiring harness to other units has been described in U.S. Pat. Nos. 5,244,417; 5,308,264; and 5,342,203, all granted to F. A. Perretta, et al., and all assigned to United Technologies Corporation. These interface systems utilize one or more semi-flexible circuit boards which are disposed in an EMI-shielding housing and are operable to shield the conductor wire connections from ambient EMI. These references describe a conductor ground ring which provides a minimal inter-conductor unshielded window within the backshell housing. Signal leakage from the individual conductors is minimized, but can still occur in the unshielded conductor segments between the stripped shielding and the ground ring. Signal leakage can also occur from the bare ends of the conductor wires where they protrude from the circuit boards at the board/wire connections. Thus, potentially undesirable amounts of signal leakage can occur within the shielded interface housing. The aforesaid patents, particularly the U.S. Pat. No. 5,342,203, describe the use of filter capacitors mounted on the circuit board and operable to filter out inter-conductor signal cross talk which might otherwise occur between high and low frequency signal conductor paths within the circuit board. The aforesaid structure minimizes inter-conductor signal path cross talk within the circuit board, but does not address all interconductor cross talk, such as pre-circuit board cross talk between stripped conductor wires within the shielded interface housing. From the aforesaid, it will be noted that incremental, yet potentially important, signal leakage and/or cross talk can occur within the interface housing. It would be desirable to provide a wire harness interface housing assembly which would completely eliminate signal leakage within the housing assembly, as well as eliminate interconductor wire signal cross talk within the housing assembly.

DISCLOSURE OF THE INVENTION

This invention relates to a wire harness backshell interface and connector assembly which is compact and lightweight in the manner described in the aforesaid patents, and which eliminates all signal leakage and interconductor cross talk between high frequency and low frequency signal conductors, which leakage and cross talk can occur within the backshell/interface connector assembly.

The interface assembly of this invention includes a first ground ring for individual conductor wires which have been stripped of their woven shielding, which ground ring provides a zero unshielded window for the conductor wires as they are threaded into the interface housing. Thus no signal leakage can occur where the conductor wires are introduced into the interface assembly.

The interface assembly of this invention also includes a second ground ring which grounds the insulation-stripped ends of each of the conductor wires on one side of the circuit board. The second ground ring eliminates signal leakage from the uninsulated bare ends of the individual conductor wires.

Still further, the interface assembly of this invention includes a signal filtering subassembly comprising a ring which includes an array of apertures through which each of the conductor wires are threaded. The apertures through which the high frequency conductor wires pass are provided with signal filtering inserts, which inserts are operative to filter out high frequency signal emissions from the shielding-stripped conductors so as to selectively eliminate cross talk from high frequency signal transmission conductors to low frequency signal transmission conductors within the interface assembly.

It is, therefore, an object of this invention to provide an improved wire harness backshell interface assembly which eliminates signal leakage within the backshell housing.

It is a further object of this invention to provide a wire harness backshell interface assembly of the character described which eliminates high frequency signal conductor to low frequency signal conductor cross talk within the backshell housing.

It is an additional object of this invention to provide a wire harness backshell interface assembly of the character described which is easily assembled.

These and other objects and advantages of the invention will become more readily apparent from the following detailed description of a preferred embodiment thereof when taken in conjunction with the accompanying drawings, in which:

BEST MODE FOR CARRYING OUT THE INVENTION

Figure 1:
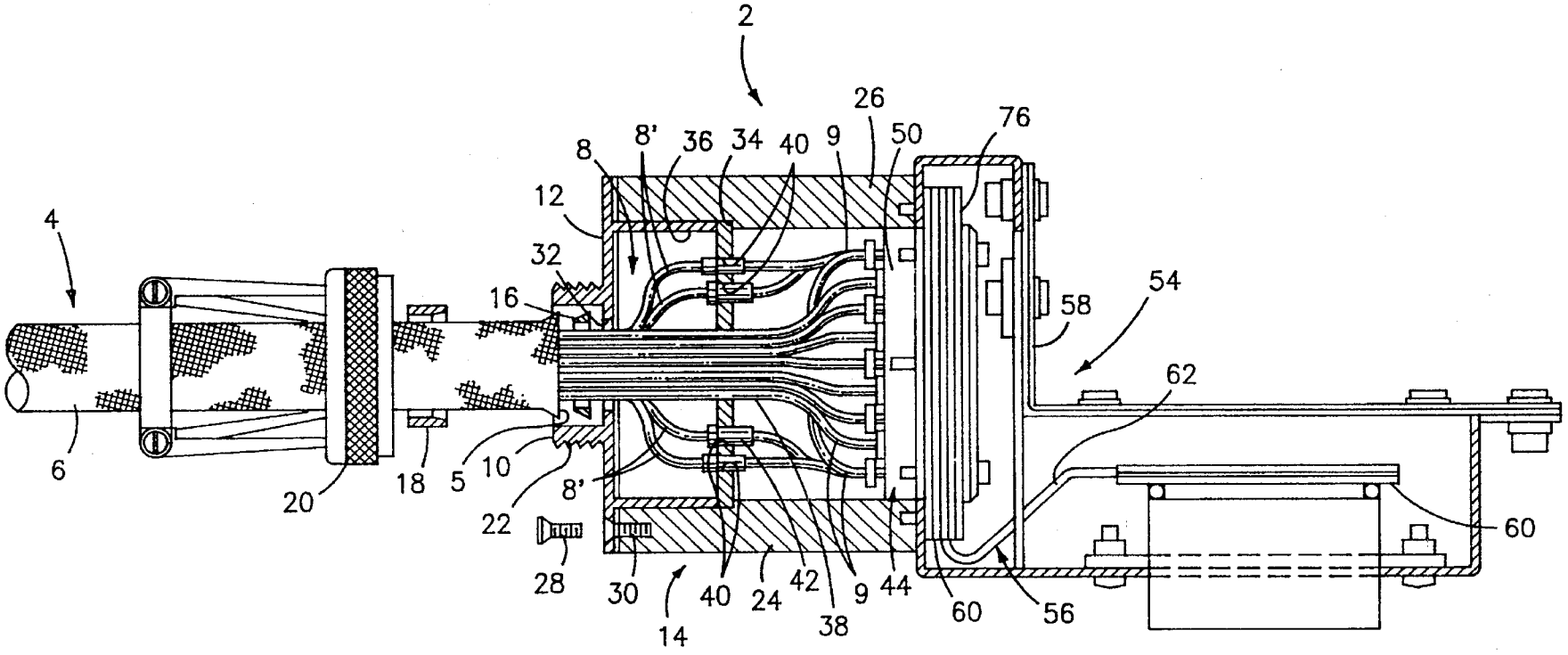
FIG. 1 is a fragmented side elevational view, taken partially in section, of a wire harness backshell interface assembly formed in accordance with this invention.

Referring now to the drawings, there is shown in FIG. 1 a wire harness backshell interface assembly, denoted generally by the numeral 2, which is formed in accordance with this invention. The wire harness 4 has an outer braided wire sheath 6 which shields the individual conductor wires, which are disposed within the sheath 6, from ambient EMI. The outer sheath 6 is stripped from the inner individual conductor wires 8 inside of a boss 10 formed on a cover plate 12 which forms a part of the backshell housing 14. A ferrule 16 is disposed inside of the boss 10 and underlies the stripped end 5 of the outer sheath 6. A clamp ring 18 encircles the outer sheath 6 and is clamped over the sheath 6 inside of the boss 10. A strain relief member 20 is threaded onto the external threaded surface 22 on the boss 10 so as to secure the wire harness 4 to the backshell housing cover plate 12.

The backshell housing 14 is formed from a pair of complementary split halves 24 and 26 which nest into each other to form the closed annular side wall of the housing. The two halves 24 and 26 are secured together by means of a plurality of screws 28 which screw into threaded holes 30 in the halves 24 and 26 to fasten the cover plate 12 to both of the housing halves 24 and 26. The individual conductor wires 8 pass through an opening 32 in the cover plate 12. The housing halves 24 and 26 are provided with a counterbore 34 in which a cup-shaped filter ring member 36 is seated. The filter ring 36 has a central enlarged opening 38 through which the lower frequency signal conductor wires 8 pass. The filter ring 36 also has a plurality of radially outwardly spaced restricted openings 40 through which the higher frequency signal conductor wires 8' pass. The restricted openings 40 contain annular capacitor filters 42 which surround the higher frequency signal wires 8' and serve to filter out high frequency cross talk interference. This protects the lower frequency lines 8 from being exposed to high frequency interference noise, commonly referred to as "cross talk". All of the individual conductor wires 8 and 8' are stripped of their individual protective sheaths 9 and the bare wires are fed into a grounding ring 44 which is secured to the housing halves 24 and 26, and grounded by reason of the housing halves 24 and 26 being grounded to whatever vehicle or site the assembly 2 is used in.

Figure 2:
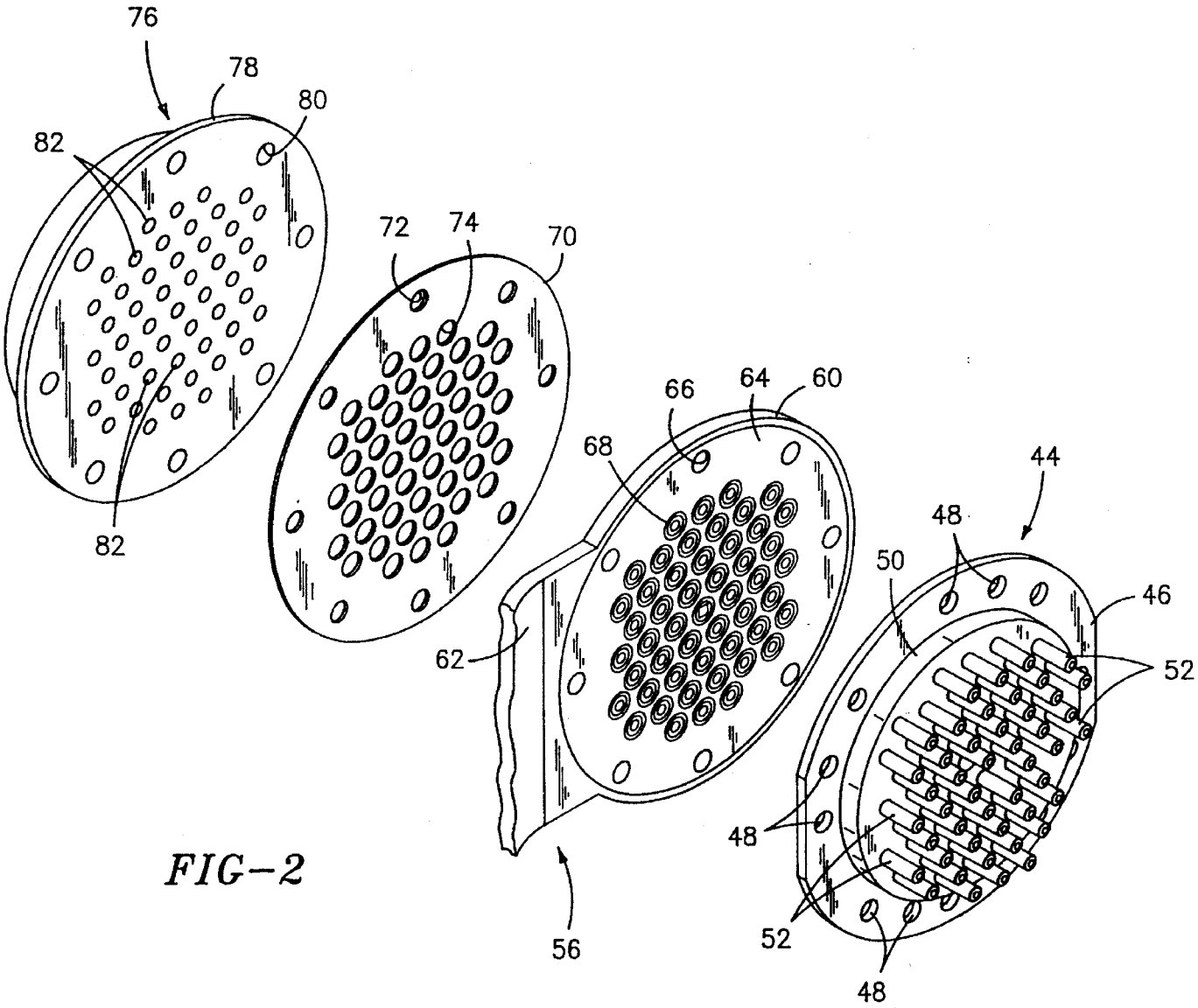
FIG. 2 is an exploded perspective view of the ground ring components of the assembly of FIG. 1.

Details of the grounding ring 44 are shown in FIG. 2. The grounding ring 44 includes an annular flange 46 having a plurality of holes 48 for reception of securement screws (not shown) which are used to fasten the grounding ring 44 to the housing halves 24 and 26. The flange 46 abuts the housing 14 so as to provide the desired electrical ground for the ring 44. The ring 44 includes a hub 50 which projects into the housing 14. The hub 50 includes an array of annular projecting fingers 52 through which the bare conductor wires pass. The stripped individual conductor sheaths 9 are telescoped over the exterior of each of the fingers 52. The use of a grounding ring 44 which has a projection or projections that extend toward and receive the bare conductor wires while also providing direct contact with the conductor wire sheaths 9 ensure that there is no unprotected increment of the conductor wires between the individual conductor sheaths 9 and the grounding ring 44. The grounding ring 44 thus does not permit any signal leakage from the individual stripped bare conductor wires as the conductor wires enter the circuit board housing component 54 of the assembly 2 (shown in FIG. 1).

Referring back to FIG. 1, the housing component 54 contains one or more semiflexible circuit boards 56. The housing 54 is operable to shield the components which it contains from ambient EMI. The housing component 54 is grounded by being secured to the grounded housing 14 by means of the same screws that secure the grounding ring 44 to the housing 14. The housing 54 includes a removable cover plate 58 which allows access to the interior of the housing 54. The semi-flexible circuit board 56 includes opposite rigid end portions 60, and an intermediate flexible portion 62. Conductor wire or pin connections are made with the circuit board 56 at the rigid ends 60, and the flexible portion 62 contains conductor paths which extend between the end portions 60.

FIG. 2 shows details of a typical semi-flexible circuit board 56. The rigid end 60 of the board 56 includes an annular metal ground ring 64 with an array of openings 66. The openings 66 receive the screws which secure the grounding ring 44 to the housing 14, whereby the board 56 is secured to the remainder of the, assembly with the metal ring 64 being disposed in face-to-face contact with the flange 46 of the grounding ring 44. The metal ring 64 thus serves as a ground transfer through the board 56. The end 60 of the board 56 also includes a plurality of embedded conductive metal rings 68 to which the bare metal conductor wires are soldered, or otherwise connected. The rings 68 are electrically connected to conductor paths (not shown) which extend through the flexible part 62 of the board 56. When the bare conductor wires are soldered to the circuit board rings 68, bare ends of the wires may project beyond the distal side of the rigid end 60 of the circuit board 56. When this occurs, the exposed bare conductor wires produce potential signal leakage paths. When more than one circuit board 56 is included in the assembly, an intermediate ground transfer disc 70 having holes 74 through which the individual bare conductor wires can pass to subsequent circuit boards 56. The disc 70 also includes openings 72 for passage of the securement screws referred to above.

Any bare wires that may extend beyond the last circuit board 56 in the assembly 2 will project into a grounding cap 76 which includes an outer flange 78 (shown in FIG. 2) which includes screw fastening holes 80. The grounding cap 76 abuts the above-described components 60 or 70, as included, so as to be electrically connected to the housing 14 for grounding purposes. The grounding cap 76 includes an array of blind holes 82 which are aligned with respective ones of the circuit board rings 68. Thus, each of the circuit board rings 68 has an aligned respective blind hole 82 in the grounding cap 76. Some ends of the bare conductor wires may project beyond the circuit board conductive rings 68 or the ground ring openings 74, in the event that a ground ring 70 is included in the assembly. Any such projecting conductor wire ends will be positioned in a respective one of the blind holes 82 in the grounding cap 76. In this manner, any signal leakage emitted by such bare conductor ends will go to ground via the grounding cap 76. Inter-conductor wire noise caused by signal leakage from bare wires is thus eliminated from the connector assembly 2.

It will be noted that the inclusion of the filter ring and filters in the connector assembly eliminates inter-conductor high frequency to low frequency signal cross talk. The use of the grounding ring eliminates inter-conductor noise caused by signal leakage from stripped conductor wires entering the connector assembly from the cable harness. Finally, the use of the stripped conductor wire grounding cap eliminates inter-conductor noise caused by signal leakage from stripped conductor wire ends projecting from the current boards. The assembly of this invention is thus capable of eliminating inter-conductor noise caused by bare wire signal leakage, and is also capable of eliminating high frequency to low frequency signal cross talk interference. The connector assembly of this invention will thus eliminate all inter-conductor interference which can occur within the backshell connector assemblies which are disclosed in the patents identified first above.

Since many changes and variations of the disclosed embodiments of the invention may be made without departing from the inventive concept, it is not intended to limit the invention otherwise than as required by the appended claims.

What is claimed is:

1. An interface system for interconnecting individual signal conductor wires to at least one multiconductor path circuit board in a grounded environment, said system comprising:

a) an ambient EMI-shielding housing which is grounded to said grounded environment, and in which said circuit board is disposed;

b) an ambient EMI-shielding wire harness containing said individual signal conductor wires, each of said signal conductor wires having its own individual shielding sheath; and c) a grounding ring secured to said housing and electrically grounded by said housing said grounding ring having a first surface abutting said circuit board, said grounding ring including a plurality of passages through which individual stripped bare conductor wires extend prior to their being connected to said circuit board, and said grounding ring including a second surface distal of said first surface, which second surface projects toward said wire harness and extends beneath said individual shielding sheaths so that said second surface serves to electrically ground said bare conductor wires internally of their individual shielding sheaths.

2. The interface system of claim 1 wherein said second surface on said grounding ring includes a hub and a plurality of tubular projections on said hub through which the individual bare conductor wires pass and said tubular projections extending beneath the stripped shielding sheaths so as to separate the bare wires from their respective shielding sheaths.

3. The interface system of claim 1 further including a split ring housing mounted on said grounding ring hub, said split ring housing being connected to said EMI-shielding housing, and said split ring housing covering and protecting said second surface on said grounding ring.

4. The interface system of claim 3 further including a filter ring disposed in said split ring housing, said split ring including restricted passages through which high frequency signal transmitting conductor wires extend, said restricted passages containing filters which are operable to prevent high frequency to low frequency interconductor wire cross talk within the interface system.

5. The interface system of claim 4 wherein said filter ring includes at least one additional passage through which low frequency signal transmission conductor wires extend.

6. The interface system of claim 1 further comprising a grounding cap disposed on a side of said circuit board distal of said grounding ring, which grounding cap is electrically grounded to said grounding ring, said grounding cap having a plurality of blind passages therein which blind passages are positioned so as to receive individual increments of bare conductor wire which may project beyond said circuit board, whereby said grounding cap is operable to eliminate post circuit board interconnector wire interference caused by signal emissions from said projecting bare conductor wire increments.

7. An interface system for interconnecting individual signal conductor wires to at least one multiconductor path circuit board in a grounded environment, said system comprising:

a) an ambient EMI-shielding housing which is grounded to said grounded environment, and in which said circuit board is disposed;

b) a wire harness containing said individual signal conductor wires, each of said signal conductor wires having an individual shielding sheath, said individual shielding sheaths being stripped away from said conductor wires to create bare wire end portions which are electrically connected to selected conductor paths in said circuit board; and c) a grounding cap disposed adjacent to said circuit board, said grounding cap being electrically grounded to said housing, and said grounding cap having a plurality of blind passages which blind passages are positioned so as to receive individual increments of bare conductor wire which may project beyond said circuit board, whereby said grounding cap is operable to eliminate post circuit board interconductor wire interference caused by signal emissions from said projecting bare conductor wire increments.

8. An interface system for interconnecting individual signal conductor wires to at least one multi-conductor path circuit board in a grounded environment, said system comprising:

a) an ambient EMI-shielding housing which is grounded to said grounded environment, and in which said circuit board is disposed;

b) a wire harness containing said individual signal conductor wires, each of said signal conductor wires having an individual shielding sheath; and c) a filter ring in said assembly between said wire harness and said circuit board, said filter ring including restricted passages through which high frequency signal transmitting conductor wires extend, said restricted passages containing filters which are operable to prevent high frequency to low frequency inter-conductor wire cross talk within the interface system.

9. The interface system of claim 8 wherein said filter ring includes at least one additional passage through which low frequency signal transmission conductor wires extend.

10. An interface system for interconnecting individual signal conductor wires to at least one multi-conductor path circuit board in a grounded environment, said system comprising:

a) an ambient EMI-shielding housing which is grounded to said grounded environment, and in which said circuit board is disposed;

b) a wire harness containing said individual signal conductor wires, each of said signal conductor wires having its own individual shielding sheath;

c) a split ring housing interposed between said wire harness and said shielding housing, said split ring housing having mating halves which combine to form said split ring housing, said individual signal conductor wires passing through said split ring housing to said shielding housing;

d) a cover plate interposed between said wire harness and said split ring housing, said cover plate including a passage through which said signal conductor wires pass from said wire harness into said split ring housing; and e) means for securing said cover plate to said mating halves of said split ring housing to join said halves together to form said split ring housing.

11. The interface system of claim 10 further comprising a grounding ring between said split ring housing and said shielding housing, said grounding ring projecting into said split ring housing, and having a plurality of passages through which bare ends of said individual conductor wires pass from said split ring housing to said circuit board.

12. The interface system of claim 11 further comprising a filter ring disposed in said split ring housing between said wire harness and said grounding ring, said filter ring including restricted passages through which high frequency signal transmitting conductor wires extend, said restricted passages containing filters which are operable to prevent high frequency to low frequency inter-conductor wire cross talk within the interface system.

* * * * *